US008970643B2

(12) United States Patent
Matsumoto

(10) Patent No.: US 8,970,643 B2
(45) Date of Patent: Mar. 3, 2015

(54) DISPLAY APPARATUS LIGHT EMISSION CONTROL METHOD AND DISPLAY UNIT

(71) Applicant: Nichia Corporation, Anan-shi, Tokushima (JP)

(72) Inventor: Makoto Matsumoto, Tokushima (JP)

(73) Assignee: Nichia Corporation, Anan-shi (JP)

( * ) Notice: Subject to any disclaimer, the term of this patent is extended or adjusted under 35 U.S.C. 154(b) by 186 days.

(21) Appl. No.: 13/676,014

(22) Filed: Nov. 13, 2012

(65) Prior Publication Data

US 2013/0120477 A1 May 16, 2013

(30) Foreign Application Priority Data

Nov. 15, 2011 (JP) ..... 2011-250182

(51) Int. Cl.
*G09G 3/32* (2006.01)
*G09G 5/10* (2006.01)
*G09G 3/20* (2006.01)

(52) U.S. Cl.
CPC .. *G09G 3/32* (2013.01); *G09G 5/10* (2013.01); *G09G 3/2025* (2013.01); *G09G 2300/06* (2013.01); *G09G 2310/0202* (2013.01)
USPC ..... 345/690

(58) Field of Classification Search
CPC combination set(s) only.
See application file for complete search history.

(56) References Cited

U.S. PATENT DOCUMENTS

| | | | | |
|---|---|---|---|---|
| 8,242,982 | B2 * | 8/2012 | Kang et al. | 345/76 |
| 8,279,160 | B2 * | 10/2012 | Tanaka | 345/102 |
| 2008/0284354 | A1 * | 11/2008 | Chen et al. | 315/294 |
| 2009/0213103 | A1 * | 8/2009 | Tanaka | 345/211 |

FOREIGN PATENT DOCUMENTS

JP 2006-147933 6/2006

* cited by examiner

*Primary Examiner* — Van Chow
(74) *Attorney, Agent, or Firm* — Mori & Ward, LLP

(57) ABSTRACT

A light emission control method controls a display that includes a display portion, a scanning portion, and a driving portion. The display portion includes light emitting elements in a matrix form. The scanning portion is connected to common lines. Each common line is connected to the anode terminals of corresponding elements in corresponding row so that the common lines are scanned. The driving portion is connected to driving lines. Each driving line is connected to the cathodes terminals of corresponding elements in a corresponding column. The driving portion can drive selected elements when the common line corresponding to the selected elements is scanned. The method displays an image in each cycle including frames. All common lines are scanned in each frame. A part of the rows in one frame in one cycle is/are driven. Other part is driven in a frame after the one frame in the one cycle.

14 Claims, 11 Drawing Sheets

DISPLAY APPARATUS LIGHT EMISSION CONTROL METHOD AND DISPLAY UNIT

BACKGROUND OF THE INVENTION

1. Field of the Invention

The present invention relates to a display unit that employs light emitting elements arranged in a matrix, and a light emission control method for a display apparatus that employs the display units.

2. Description of the Related Art

Display units that employ light emitting diodes (LEDs) as light emitting elements, and display apparatuses that employ the display units have been manufactured. For example, a large display apparatus can be constructed of a plurality of display units that cooperate with each other. In the case where a display unit is constructed in a matrix with m rows and n columns for example, the anode terminals of LEDs that are arranged in each row are connected to corresponding one common line, while the cathode terminals of LEDs that are arranged in each column are connected to corresponding one driving line. The common lines of m rows are cyclically turned ON one by one at a predetermined sub-frame. When one of the common lines is turned ON, each of the driving lines can drive corresponding one of LEDs that are arranged on the one of the common lines, which is turned ON.

In this display unit control method, there is a problem that the brightness of light emitting elements that are first driven in each cycle may be smaller as compared with other light emitting elements. The reason is described with reference to FIGS. 10 to 12. FIG. 10A is a plan view schematically showing a display unit. FIG. 10B is a plan view schematically showing the display unit with the brightness of a row being smaller. FIG. 11 is a timing chart showing the light emission timing of light emitting elements 1 in a conventional display unit. The following description describes the case where one cycle is divided into a plurality of frames for displaying an image. The frames are controlled so that an image can be displayed as a whole. FIGS. 12A to 12H are circuit diagrams showing the current flows in the display unit in sub-frames 11 to 23 in FIG. 11. FIGS. 12A, 12B, 12C, 12D, 12E, and 12F show the sub-frames 11, 12, 13, 21, 22, and 23, respectively, in the cycle CL1. FIG. 12G shows the state where residual electric charge is stored. FIG. 12H shows the sub-frame 11 in the cycle CL2 or later. In FIGS. 12A to 12H, light emitting elements 1 shown in black are light emitting elements 1 that emit light at a desired amount of intensity. Current flows are shown by the arrows. Virtual equivalent capacitors $C_{S0}$ to $C_{S2}$ that are included as parasitic capacitances in the lines are shown on the driving lines S0 to S2 (hereinafter, S0 to S2 are occasionally referred to as simply lines "S").

The display unit shown in FIGS. 10A and 10B includes a display portion in a matrix with three rows and three columns. Each dot includes an LED as light emitting element. This display unit will have the circuit construction states shown in FIGS. 12A to 12H. The display unit includes the light emitting elements 1 that are arranged in the matrix with three rows and three columns (totally nine light emitting elements), three common lines C0 to C2 (hereinafter, C0 to C2 are occasionally referred to as simply lines "C"), the three driving lines S0 to S2, a scanning portion 20, and a driving portion 30. Each of the common lines C0 to C2 is connected to the anode terminals of three light emitting elements 1, which are arranged in corresponding one of the three rows. Each of the three driving lines S0 to S2 is connected to the cathode terminals of three light emitting elements 1 that are arranged in corresponding one of the three columns. The common lines C0 to C2 are scanned by the scanning portion 20. The driving portion 30 can draw currents from the driving lines S0 to S2 so that the currents can flow through light emitting elements 1.

FIG. 11 shows the light emission timing chart of the display unit. As shown in this chart, the first cycle CL is indicated by CL1. The first cycle CL is first provided to the display unit after power is supplied. The second and third cycles are indicated by CL2 and CL3, respectively. Each of CL1 to CL3 is divided into a plurality of frames FM. In the frames, the scanning order of the common lines C is the same order of C0, C1, and C2. The assumed operation is that, in each cycle, all of the light emitting elements are driven at the minimum intensity (the minimum level) only in FM1, and all of the light emitting elements are turned OFF in other frames. That is, the assumed operation is that, in each of the cycles CL1 to CL3, all the light emitting elements emit light at the minimum intensity. In FIG. 11, although it is shown as if the light emitting elements 1 connected to S0, S1, and S2 are driven at the maximum intensity (maximum level) in the sub-frames 11, 12, and 13 in each cycle for ease of illustration, the assumed operation is that the light emitting elements are driven at the minimum intensity (the minimum level) in FM1.

The operation in the cycle CL1 is now described with reference to FIG. 12A. In the sub-frame 11 where the common line C0 to be first scanned is turned ON in the frame FM1, a voltage is applied to the common line C0 by the scanning portion 20, while predetermined currents are drawn by the driving portion 30 through the driving lines S0 to S2. Accordingly, three light emitting elements 1 that are connected to C0 are driven at a desired amount of intensity. Subsequently, in the sub-frame 12, as shown by FIG. 12B, the voltage is applied to the common line C1 by the scanning portion 20, while predetermined currents are drawn by the driving portion 30 through the driving lines S0 to S2. Accordingly, three light emitting elements 1 that are connected to C1 are driven at a desired amount of intensity. Similarly, in the sub-frame 13, as shown in FIG. 12C, three light emitting elements 1 that are connected to C2 are driven at a desired amount of intensity.

After that, in the sub-frame 21 in the frame FM2, as shown in FIG. 12D, although the voltage is applied to the common line C0, the driving lines are in the OFF state so that the driving portion 30 does not draw currents. Accordingly, the parasitic capacitances of the lines (S0, S1, and S2) will be charged. Similarly, in the sub-frame 22, as shown in FIG. 12E, although the voltage is applied to the common line C1, the driving portion 30 does not draw currents. Accordingly, the parasitic capacitances of the lines (S0, S1, and S2) will be also charged. Similarly, in the sub-frame 23, as shown in FIG. 12F, the parasitic capacitances of the lines (S0, S1, and S2) will be also charged. In this case, since the lines are similarly scanned in the frames, the parasitic capacitances of the lines will be fully charged and cannot be charged anymore as shown in FIG. 12G.

The operation in the cycle CL2 is now described. The light intensity of a light emitting element that is first driven will be smaller in the cycle CL2 as compared with the cycle CL1. That is, as shown by FIG. 12H, since, in the sub-frame 11 in the frame FM1, the voltage is applied to the common line C0 by the scanning portion 20, and predetermined currents are drawn by the driving portion 30 through the driving lines S0 to S2, three light emitting elements 1 that are connected to C0 are driven.

However, since the parasitic capacitances of the driving lines S0 to S2 are charged in the cycle CL1, the amounts of the currents that are drawn by the driving portion through the driving lines S0 to S2 include not only currents that flow in the light emitting elements 1 but also currents from the parasitic capacitances. That is, since the current that actually flows in the light emitting element 1 in the sub-frame 11 decreases by the amount of current that is discharged by the parasitic capacitance relative to the currents in other sub-frames 12 and 13, the light emission amount of the light emitting element 1 that is connected to C0 in the sub-frame of the cycle CL2 will be smaller as compared with other light emitting elements 1 that are connected to C1 and C2. As a result, a dark line may appear.

In FIG. 11, to show that light emitting elements 1 may be darker in the sub-frames 11 of the cycles CL2 and CL3, the sub-frame blocks indicating that C0 is in the ON state are hatched in the cycles CL2 and CL3. Also, in FIG. 12H, to show that the parasitic capacitances may reduce the amounts of light intensity of light emitting elements 1, these light emitting elements 1 are hatched.

Subsequently, in the sub-frame 12, as shown by FIG. 12B, the voltage is applied to the common line C1 by the scanning portion 20, while predetermined currents are drawn by the driving portion 30 through the driving lines S0 to S2. Since the currents corresponding to the parasitic capacitances have been drawn out by the driving portion 30 in the frame FM1, three light emitting elements 1 that are connected to C1 can be driven at a desired amount of intensity. Similarly, in the sub-frame 13, as shown in FIG. 12C, three light emitting elements 1 that are connected to C2 can be driven at a desired amount of intensity. Since the operation after the sub-frame 21 is similar to the cycle CL1, its description is omitted for the sake of brevity. In addition, after the cycle CL3, similarly, light emitting elements 1 may be darker in the sub-frame 11. Since the reason is the same as CL2, its description is omitted for the sake of brevity.

As stated above, in conventional driving methods, the parasitic capacitances may reduce the amounts of light intensity of light emitting elements. For this reason, there is a problem that the darker light emitting elements may inversely affect the display quality.

See Laid-Open Patent Publication No. JP 2006-147,933 A

The present invention is devised to solve the above problems. It is a main object of the present invention to provide a display apparatus light emission control method and a display unit that can prevent that the amount of light intensity of a light emitting element that is first driven in each cycle is smaller than other light emitting elements, and can improve the display quality.

SUMMARY OF THE INVENTION

To achieve the above object, a light emission control method according to a first aspect of the present invention controls a display apparatus that includes a display portion 10, a scanning portion 20, and a driving portion 30. The display portion 10 includes a plurality of light emitting elements 1 that are arranged in a matrix form. The scanning portion 20 is connected to a plurality of common lines C. Each of plurality of common lines C is connected to the anode terminals of corresponding elements of the plurality of light emitting elements 1 that are arranged in corresponding one of the rows of the display portion 10 so that the common lines C are scanned. The scanning portion 20 applies a voltage to selected one of the common lines C. The driving portion 30 is connected to a plurality of driving lines S. Each of the driving lines S is connected to the cathodes terminals of corresponding elements of the plurality of light emitting elements 1 that are arranged in corresponding one of the columns of the display portion 10. The driving portion 30 can drive selected elements of the plurality of light emitting elements 1 when one of the common lines corresponding to the selected elements is scanned by the scanning portion. The display apparatus displays an image in each cycle that includes a plurality of frames. All of the common lines C are scanned by the scanning portion 20 in each of the plurality of frames. One(s) of the rows in one frame in one cycle is/are driven. Other one(s) or the other rows are driven in a frame after the one frame in the one cycle. According to this construction, since different rows are driven in different frames in one cycle, it is possible to suppress the phenomenon where the parasitic capacitance of the driving line reduces the amount of light intensity of a particular row (dark line).

In a light emission control method according to a second aspect of the present invention, a non-light-emission period can be provided between a driving sub-frame in which a predetermined row(s) is/are driven and the next driving sub-frame in which other row(s) is/are driven. In the non-light-emission period, one or more common lines are scanned by the scanning portion and the driving portion prevents current flows in the light emitting elements. According to this construction, the periods for activation of the driving lines can be distributed. As a result, it is possible to reduce the duration of a non-light-emission period where the driving lines are deactivated so that the light emitting elements do not emit light. Therefore, it is possible to suppress the appearance of dark line.

In a light emission control method according to a third aspect of the present invention, the duration of a non-light-emission period can be constant. According to this construction, since the duration of a time period where electric charge is charged as the parasitic capacitances of the driving lines can be constant, the light emission amounts of the light emitting elements in the rows can be constant. Therefore, it is possible to prevent the phenomenon where light emitting elements in a particular row become darker.

In a light emission control method according to a fourth aspect of the present invention, the same image can be displayed in continuous cycles. According to this construction, in still pictures, it is possible to suppress the appearance of dark line where a particular row becomes darker.

A light emission control method according to a fifth aspect of the present invention controls a display apparatus that includes a display portion 10, a scanning portion 20, and a driving portion 30. The display portion 10 includes a plurality of light emitting elements 1 that are arranged in a matrix form. The scanning portion 20 is connected to a plurality of common lines C. Each of plurality of common lines C is connected to the anode terminals of corresponding elements of the plurality of light emitting elements 1 that are arranged in corresponding one of the rows of the display portion 10 so that the common lines C are scanned. The scanning portion 20 applies a voltage to selected one of the common lines C. The driving portion 30 is connected to a plurality of driving lines S. Each of the driving lines S is connected to the cathodes terminals of corresponding elements of the plurality of light emitting elements 1 that are arranged in corresponding one of the columns of the display portion 10. The driving portion 30 can drive selected elements of the plurality of light emitting elements 1 when one of the common lines corresponding to the selected elements is scanned by the scanning portion. The display apparatus displays an image in each cycle that includes a plurality of frames. All of the common lines C are scanned by the scanning portion 20 in each of the plurality of frames. The rows of the display portion 10 are driven in a first light emission order so that the image is displayed in a first cycle. The rows of the display portion 10 are driven in a second cycle next to the first cycle in a second light emission order so that the image same as the first cycle is displayed. The row that is first driven in the second light emission order is different from the row that is first driven in the first light emission order. According to this construction, since the driving orders are different between frames in one cycle, it is possible to distribute the reduction amounts of light emission caused by the parasitic capacitances of the driving lines to the rows. Therefore, it is possible to suppress the appearance of dark line where a particular row becomes darker.

In a light emission control method according to a sixth aspect of the present invention, a non-light-emission period can be provided between a driving sub-frame in which a predetermined row(s) is/are driven and the next driving sub-frame in which other row(s) is/are driven. In the non-light-emission period, one or more common lines are scanned by the scanning portion and the driving portion prevents current flows in the light emitting elements. According to this construction, although the common line scanning order is not changed, since the periods for activation of the driving lines are distributed, it is possible to reduce the duration of a non-light-emission period where the driving lines are deactivated so that the light emitting elements do not emit light. Therefore, it is possible to suppress the appearance of dark line.

In a light emission control method according to a seventh aspect of the present invention, the orders in which the common lines are scanned in the frames by the scanning portion can be different between successive cycles. According to this construction, although activation timing of the driving lines is not changed, since the scanning order of the common lines is set different between cycles, it is possible to distribute light emitting elements the light emission amounts of which are reduced caused by the parasitic capacitances of the driving lines. Therefore, it is possible to suppress the phenomenon where particular light emitting elements become darker, that is, to make the phenomenon inconspicuous.

A display unit according to an eighth aspect of the present invention includes a display portion 10, a scanning portion 20, and a driving portion 30. The display portion 10 includes a plurality of light emitting elements 1 that are arranged in a matrix form. The scanning portion 20 is connected to a plurality of common lines C. Each of plurality of common lines C is connected to the anode terminals of corresponding elements of the plurality of light emitting elements 1 that are arranged in corresponding one of the rows of the display portion 10 so that the common lines C are scanned. The scanning portion 20 applies a voltage to selected one of the common lines C. The driving portion 30 is connected to a plurality of driving lines S. Each of the driving lines S is connected to the cathodes terminals of corresponding elements of the plurality of light emitting elements 1 that are arranged in corresponding one of the columns of the display portion 10. The driving portion 30 can drive selected elements of the plurality of light emitting elements 1 when one of the common lines corresponding to the selected elements is scanned by the scanning portion. The display unit is constructed to display an image in each cycle that includes a plurality of frames. All of the common lines are scanned by the scanning portion 20 in each of the plurality of frames. The display unit further includes a light emission control portion 2 that drives one(s) of the rows in one frame in one cycle, and drives other one(s) or the other rows in another frame in the one cycle. According to this construction, since different rows are driven in different frames in one cycle, it is possible to suppress the phenomenon where the parasitic capacitance of the driving line reduces the amount of light intensity of a particular row (dark line).

In a display unit according to a ninth aspect of the present invention, the light emission control portion 2 can have a non-light-emission period is provided between a driving sub-frame of a predetermined row and the next driving sub-frame of another row. In the non-light-emission period, one or more common lines are scanned by the scanning portion and the driving portion prevents current flows in the light emitting elements. According to this construction, the periods for activation of the driving lines can be distributed. As a result, it is possible to reduce the duration of a non-light-emission period where the driving lines are deactivated so that the light emitting elements do not emit light. Therefore, it is possible to suppress flicker.

In a display unit according to a tenth aspect of the present invention, the non-light emission period of the light emission control portion 2 can be constant. According to this construction, since the periods where electric charge is charged as the parasitic capacitances of the driving lines can be constant, the light emission amounts of the light emitting elements in the rows can be constant. Therefore, it is possible to prevent the phenomenon where light emitting elements in a particular row become darker.

In a display unit according to an eleventh aspect of the present invention, the display unit can display the same image on the display portion 10 in continuous cycles. According to this construction, in still pictures, it is possible to suppress the appearance of dark line where a particular row becomes darker.

A display unit according to a twelfth aspect of the present invention includes a display portion 10, a scanning portion 20, and a driving portion 30. The display portion 10 includes a plurality of light emitting elements 1 that are arranged in a matrix form. The scanning portion 20 is connected to a plurality of common lines C. Each of plurality of common lines C is connected to the anode terminals of corresponding elements of the plurality of light emitting elements 1 that are arranged in corresponding one of the rows of the display portion 10 so that the common lines C are scanned. The scanning portion 20 applies a voltage to selected one of the common lines C. The driving portion 30 is connected to a plurality of driving lines S. Each of the driving lines S is connected to the cathodes terminals of corresponding elements of the plurality of light emitting elements 1 that are arranged in corresponding one of the columns of the display portion 10. The driving portion 30 can drive selected elements of the plurality of light emitting elements 1 when one of the common lines corresponding to the selected elements is scanned by the scanning portion. The display unit is constructed to display an image in each cycle that includes a plurality of frames. All of the common lines are scanned by the scanning portion 20 in one of the plurality of frames. The display unit further includes a light emission control portion 2 that, when displaying the same image in successive first and second cycles, controls the driving orders so that the row that is first driven in the second cycle is different from the row that is first driven in the first cycle. According to this construction, since the driving orders are different between frames in one cycle, it is possible to distribute the reduction amounts of light emission caused by the parasitic capacitances of the driving lines to the rows. Therefore, it is possible to suppress the appearance of dark line where a particular row becomes darker.

In a display unit according to a thirteenth aspect of the present invention, the light emission control portion 2 can have a non-light-emission period is provided between a driving sub-frame of a predetermined row and the next driving sub-frame of another row. In the non-light-emission period, one or more common lines are scanned by the scanning portion and the driving portion prevents current flows in the light emitting elements. According to this construction, although the common line scanning order is not changed, since the periods for activation of the driving lines are distributed, it is possible to reduce the duration of a non-light-emission period where the driving lines are deactivated so that the light emitting elements do not emit light. Therefore, it is possible to suppress the appearance of dark line.

In a display unit according to a fourteenth aspect of the present invention, the light emission control portion 2 can control the driving orders so that the orders in which the common lines C are scanned in the frames by the scanning portion are different between successive cycles. According to this construction, although activation timing of the driving lines is not changed, since the scanning order of the common lines is set different between cycles, it is possible to distribute light emitting elements the light emission amounts of which are reduced caused by the parasitic capacitances of the driving lines. Therefore, it is possible to suppress the phenomenon where a particular row becomes darker, that is, to make the phenomenon inconspicuous.

The above and further objects of the present invention as well as the features thereof will become more apparent from the following detailed description to be made in conjunction with the accompanying drawings.

DETAILED DESCRIPTION OF THE EMBODIMENT(S)

The following description will describe embodiments according to the present invention with reference to the drawings. It should be appreciated, however, that the embodiments described below are illustrations of a light emission control method and a display unit used therein to give a concrete form to technical ideas of the invention, and a light emission control method and a display unit of the invention are not specifically limited to description below. Furthermore, it should be appreciated that the members shown in claims attached hereto are not specifically limited to members in the embodiments. Unless otherwise specified, any dimensions, materials, shapes and relative arrangements of the parts described in the embodiments are given as an example and not as a limitation. Additionally, the sizes and the positional relationships of the members in each of drawings are occasionally shown larger exaggeratingly for ease of explanation. Members same as or similar to those of this invention are attached with the same designation and the same reference signs, and their description is omitted. In addition, a plurality of structural elements of the present invention may be configured as a single part that serves the purpose of a plurality of elements, on the other hand, a single structural element may be configured as a plurality of parts that serve the purpose of a single element. Also, the description of some of examples or embodiments may be applied to other examples, embodiments or the like.

In this specification, the term "parasitic capacitance" mainly refers to the parasitic capacitance of a driving line S. However, the "parasitic capacitance" is not limited to this. The "parasitic capacitance" can include the capacitive component of other part such as the capacitance of an electronic part that is connected to the driving line.

First Embodiment

Figure 1:
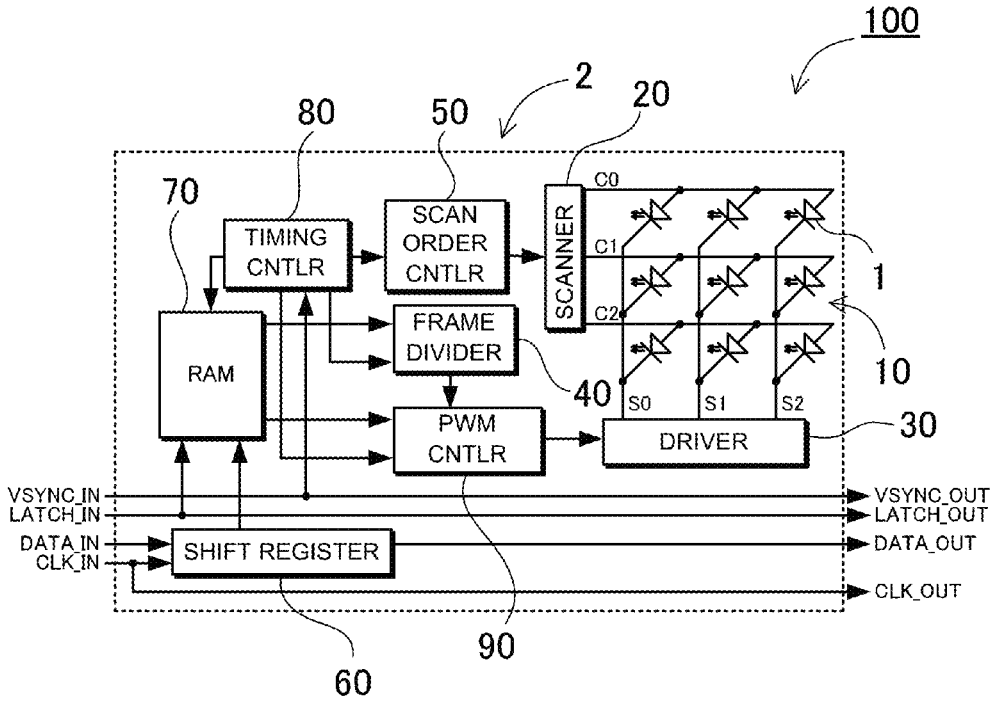
FIG. 1 is a block diagram showing a display unit according to a first embodiment of the present invention.
Figure 2:
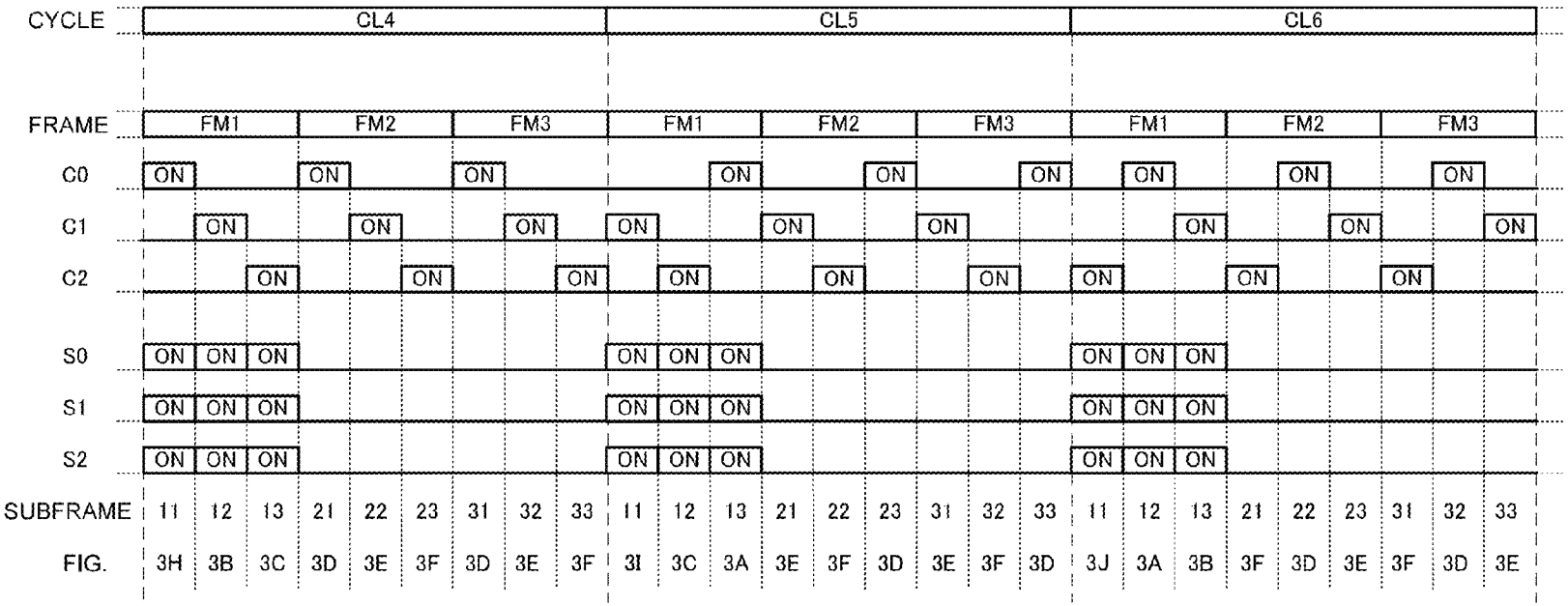
FIG. 2 is a timing chart showing a light emission control method according to the first embodiment of the present invention.

FIG. 1 is a block diagram showing a display unit 100 according to a first embodiment of the present invention. FIG. 2 is a timing chart showing a light emission control method for driving the display unit 100. FIGS. 3A to 3J are circuit diagrams showing current flows indicated by the arrows in the display unit in sub-frames shown in FIG. 2.

(Display Portion)

The display unit 100 includes a display portion 10 and a light emission control portion 2, as shown in FIG. 1. The display portion 10 includes a plurality of light emitting elements 1, a plurality of common lines C0 to C2, and a plurality of driving lines S0 to S2. The light emitting elements 1 are arranged in a matrix. Each of the common lines C0 to C2 is connected to the anode terminals of the light emitting elements 1 that are arranged in corresponding one of rows. Each of the common lines S0 to S2 are connected to the cathode terminals of the light emitting elements 1 that are arranged in corresponding one of columns.

(Light Emission Control Portion 2)

The light emission control portion 2 includes a frame dividing portion 40, a scanning portion 20, a driving portion 30, and a scanning order control portion 50. The frame dividing portion 40 divides one cycle for displaying an image into a plurality of frames. The scanning portion 20 is connected to the common lines C. The common lines C are scanned in each frame by the scanning portion 20. The scanning portion 20 can apply a voltage to the common lines C. The driving portion 30 is connected to the driving lines S, and can drive selected light emitting elements 1 in corresponding one of the frames in one cycle based on control data provided from the outside. The scanning order control portion 50 is connected to the scanning portion 20, and controls the scanning orders so that the scanning orders in which the common lines are scanned are different between the frame in a cycle and the frame in another cycle.

Figure 10A:
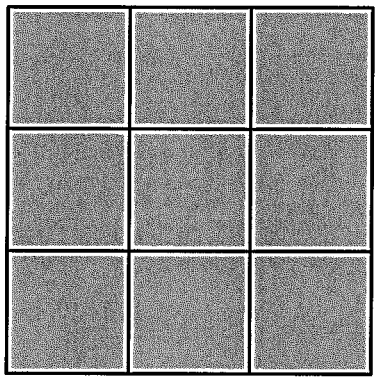
FIG. 10A (RELATED ART)
FIG. 10A is a plan view schematically showing a display unit.
Figure 10B:
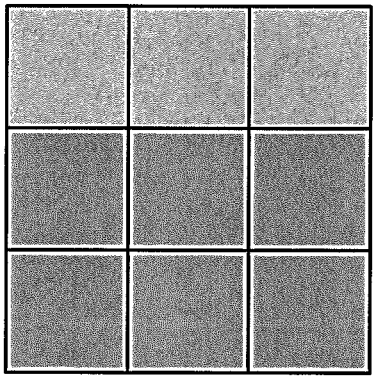
FIG. 10B (RELATED ART)
FIG. 10B is a plan view schematically showing the display unit shown in FIG. 10A with one row being darker in light emission.

The light emission control portion 2 controls the display portion 10 in the light emission control method of light emission timing shown in FIG. 2. As a result, it is possible to prevent the phenomenon where the amount of light emission of a conventional display portion 10 partially decreases as shown in FIG. 10B, that is, to prevent the appearance of dark line. Therefore, it is possible to provide uniform and quality image as shown in FIG. 10A. The following description will describe the light emission control method.

Figure 11:
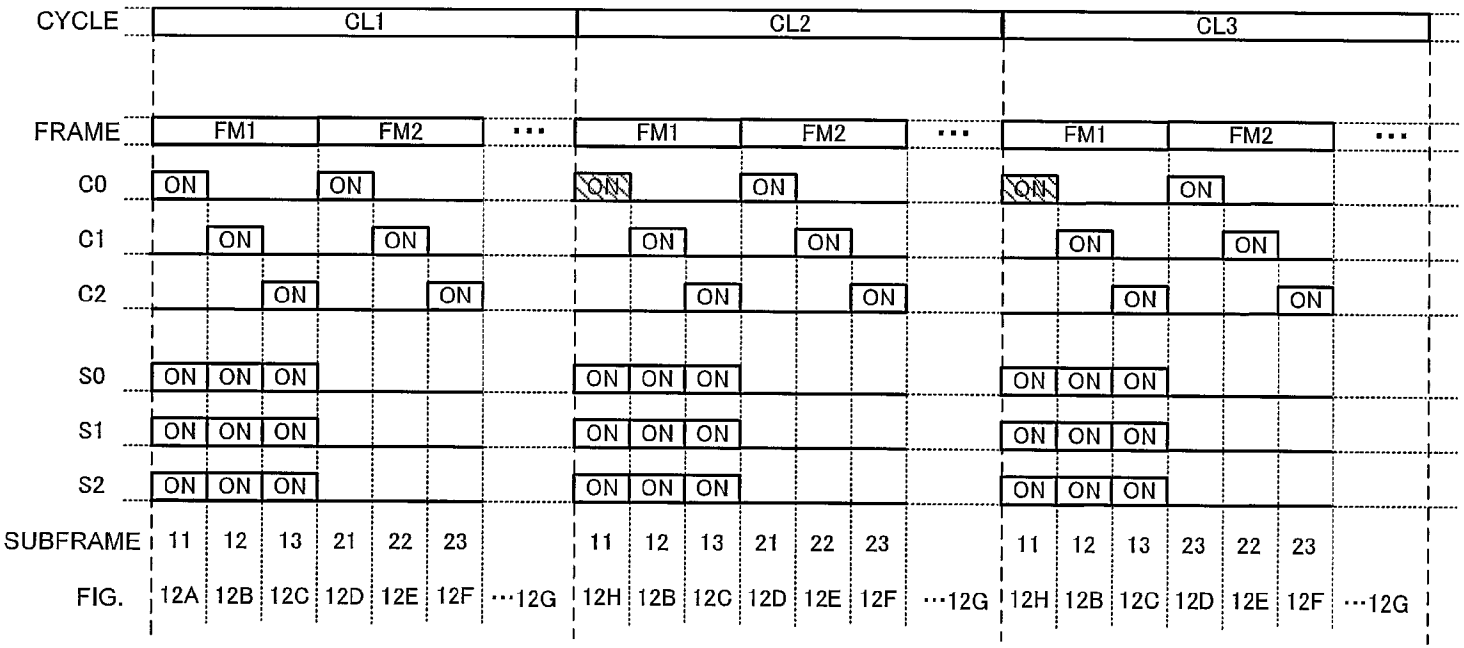
FIG. 11 (RELATED ART)
FIG. 11 is a timing chart of a conventional light emission control method for driving the display unit shown in FIG. 10.
Figure 12A:
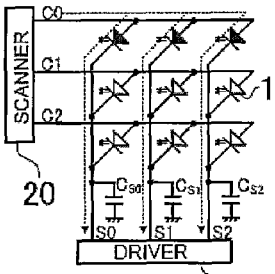
FIG. 12A (RELATED ART)
FIGS. 12A to 12H are circuit diagrams showing current flows in the display unit in sub-frames 11 to 23 shown in FIG. 11.
Figure 12B:
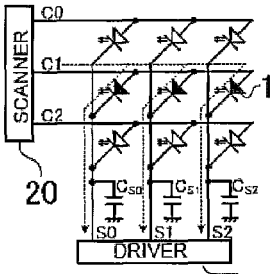
FIG. 12B (RELATED ART)
Figure 12C:
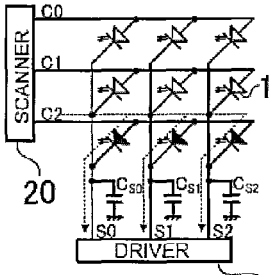
FIG. 12C (RELATED ART)
Figure 12D:
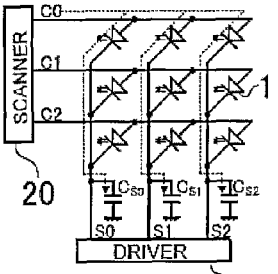
FIG. 12D (RELATED ART)
Figure 12E:
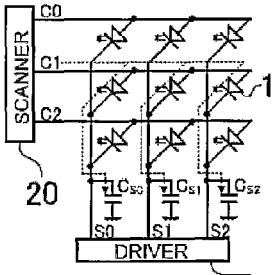
FIG. 12E (RELATED ART)
Figure 12F:
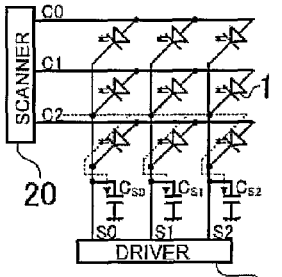
FIG. 12F (RELATED ART)
Figure 12G:
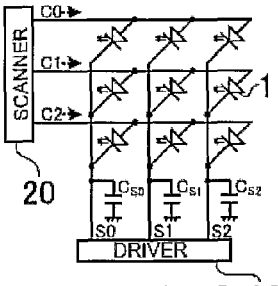
FIG. 12G (RELATED ART)
Figure 12H:
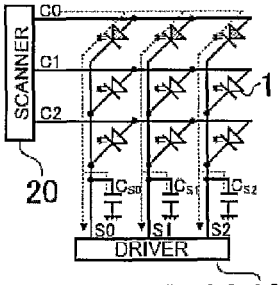
FIG. 12H (RELATED ART)

In conventional light emission control methods, the scanning order of the common lines C is set in ascending numeric order as shown in FIG. 11 in every cycle, which may cause the phenomenon where the parasitic capacitance reduces the amounts of light intensity of the emitting elements 1 that are arranged in a row and are first driven in each cycle as compared with other light emitting elements 1. The common line C that will be the dark line when turned ON is indicated as hatched blocks in FIG. 11. Although the dark line is inconspicuous in motion video or at high brightness, the dark line will be conspicuous in still image particularly at low brightness, which in turn causes poor image quality. To address this, in this embodiment, the scanning order is set different between cycles, that is, the dark line is changed depending on cycles in order to suppress that a particular row is conspicuous as the dark line.

Specifically, in the display unit 100 according to the first embodiment, the scanning order control portion 50 controls the scanning order so that the dark line will appear in C0, C1, and C2 in each frame FM1 in cycle 4, cycle 5, and cycle 6, respectively as shown in FIG. 2. According to this light emission control method, the dark line will cyclically appear on the three common lines C in a cycle of three cycles. Dissimilar to the conventional case of FIG. 10B, the dark line does not appear only in the first row. Since the row where the dark line will appear can be changed depending on cycles, the light intensity difference can be distributed. Accordingly, it is possible to prevent that the dark line will appear in a particular row. As a result, it is possible to display a more uniform image as a whole. In this embodiment, the scanning order is cyclically changed in a cycle of three cycles. For this reason, FIG. 2 illustrates the cycles CL4 to CL6.

The display unit 100 includes the light emitting elements 1, three common lines C0 to C2, and three driving lines S0 to S2, as discussed above. The light emitting elements 1 are arranged in the matrix with three rows and three columns (totally nine light emitting elements). Each of the three common lines C0 to C2 is connected to the anode terminals of three of the light emitting elements 1 that are arranged in corresponding one of rows. Each of the three driving lines S0 to S2 is connected to the cathode terminals of three of the light emitting elements 1 that are arranged in corresponding one of columns. In the light emission control method shown in FIG. 2, each of the cycles CL4 to CL6 is divided into a plurality of frames (FM1, FM2, . . . ) for driving the display portion. The assumed operation is that, in each cycle, all of light emitting elements are driven at the minimum intensity (the minimum level) only in FM1, and all of light emitting elements are turned OFF in other frames, for sake of brevity. That is, in each cycle, all of the light emitting elements are driven at the minimum intensity. In FIG. 2, although it is shown as if the light emitting elements 1 connected to the driving lines S0, S1, and S2 are driven at the maximum intensity (maximum level) in the sub-frames 11, 12, and 13 in the frame FM1 in each cycle for ease of illustration, the assumed operation is that the light emitting elements are driven at the minimum intensity (the minimum level).

Figure 3A:
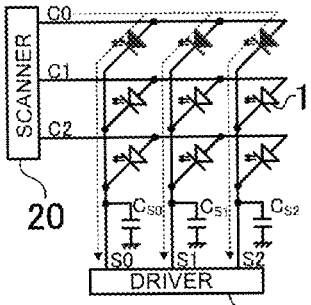
FIGS. 3A to 3J are circuit diagrams showing current flows in the display unit in sub-frames 11 to 23 shown in FIG. 2.
Figure 3B:
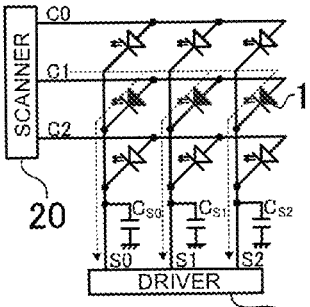
Figure 3C:
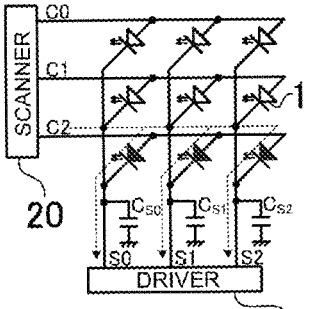
Figure 3D:
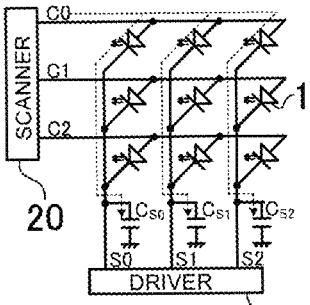
Figure 3E:
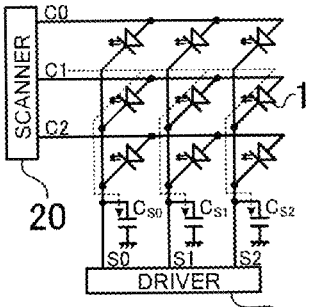
Figure 3F:
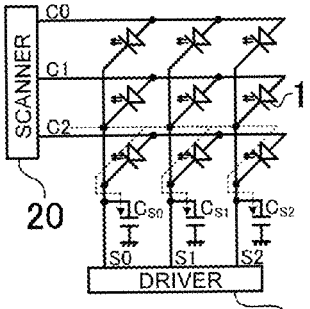
Figure 3G:
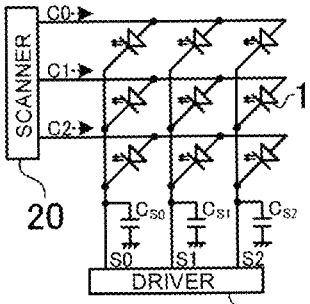
Figure 3H:
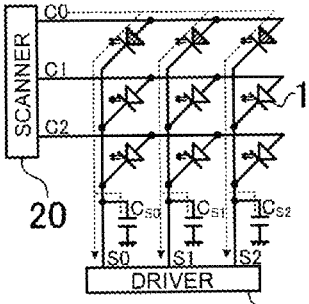

The operation of the cycle CL4 is now described. In the cycle CL4, the scanning order of the common lines C is set to the order of the common lines C0, C1, and C2 in each frame. That is, this scanning order of the common lines C is ascending numeric order. In other words, the scanning order of the common lines C in this cycle is same as conventional light emission control method shown in FIG. 11. Specifically, in the sub-frame 11 in the frame FM1 shown in FIG. 2, the voltage is applied to the common line C0 by the scanning portion 20, while predetermined currents are drawn by the driving portion 30 through the driving lines S0 to S2, as shown in FIG. 3H. As discussed above in the case of FIG. 11, the parasitic capacitance charged in the previous cycle CL3 (not shown) reduces the light intensity of the light emitting elements 1 that are connected to the common line C0, which is first selected in the cycle CL4, to a light intensity amount lower than a desired light intensity amount. In FIG. 3H, the hatched light emitting elements 1 are indicated as the light emitting elements 1 that emit light at a light intensity amount lower than a desired light intensity amount (same goes for other circuit diagrams). Current flows are shown by the arrows in FIGS. 3A to 3J. In addition, in FIGS. 3A to 3J, virtual equivalent capacitors $C_{S0}$ to $C_{S2}$ that are included as parasitic capacitances in the lines are shown on the driving lines S.

Subsequently, in the sub-frame 12, the voltage is applied to the common line C1 by the scanning portion 20, while predetermined currents are drawn by the driving portion 30 through the driving lines S0 to S2. Since the parasitic capacitances have been drawn out in the previous frame FM1, three light emitting elements 1 that are connected to the common line C1 can be driven at a desired amount of intensity as shown in FIG. 3B. Similarly, in the sub-frame 13, as shown in FIG. 3C, three light emitting elements 1 that are connected to the common line C2 are driven at a desired amount of intensity. Subsequently, in the sub-frame 21 in the frame FM2, as shown in FIG. 3D, although the voltage is applied to the common line C0, the driving portion 30 does not draw currents. Accordingly, the parasitic capacitances of the lines (S0, S1, and S2) will be charged. Also, in the sub-frame 22, as shown in FIG. 3E, although the voltage is applied to the common line C1, the driving portion 30 does not draw currents. Accordingly, the parasitic capacitances of the lines will be charged. Similarly, in the sub-frame 23, as shown in FIG. 3F, although the voltage is applied to the common line C2, the parasitic capacitances of the lines will be charged. Thus, the parasitic capacitances of the lines will be fully charged, and cannot be charged anymore as shown in FIG. 3G.

Figure 3I:
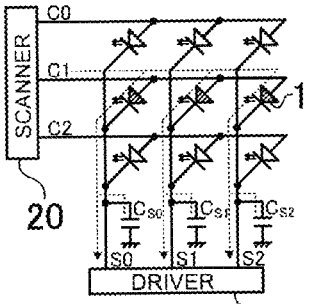

The operation in the cycle CL5 is now described. Dissimilar to the aforementioned cycle CL4, in the cycle CL5, the scanning order of the common lines C is set to the order of the common lines C1, C2, and C0 in each frame. Since, in the sub-frame 11 in the frame FM1, the voltage is first applied to the common line C1 by the scanning portion 20, and predetermined currents are drawn by the driving portion 30 through the driving lines S0 to S2, three light emitting elements 1 that are connected to the common line C1 are driven. The parasitic capacitance charged in the cycle CL4 reduces the light intensity of the light emitting elements 1 that are connected to the common line C1, which is first selected in the cycle CL5, to a light intensity amount lower than a desired light intensity amount as shown in FIG. 3I. Subsequently, in the sub-frame 12, the voltage is applied to the common line C2 by the scanning portion 20, while predetermined currents are drawn by the driving portion 30 through the driving lines S0 to S2.

Since the parasitic capacitances have been drawn out in the sub-frame 11, three light emitting elements 1 that are connected to the common line C2 can be driven at a desired amount of intensity as shown in FIG. 3C. Similarly, in the sub-frame 13, as shown in FIG. 3A, three light emitting elements 1 that are connected to C0 are driven at a desired amount of intensity. Thus, the parasitic capacitances of the lines will be also charged after the sub-frame 21.

Figure 3J:
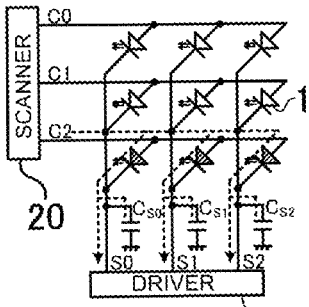

The operation in the cycle CL6 is now described. In the cycle CL6, the scanning order of the common lines C is set to the order of C2, C0, and C1 in each frame. Since, in the sub-frame 11 in the frame FM1, the voltage is first applied to the common line C2 by the scanning portion 20, and predetermined currents are drawn by the driving portion 30 through the driving lines S0 to S2, three light emitting elements 1 that are connected to C2 are driven. The parasitic capacitance reduces the light intensity of the light emitting elements 1 that are connected to the common line C2, which is first selected, to a light intensity amount lower than a desired light intensity amount as shown in FIG. 3J. Subsequently, in the sub-frame 12, the voltage is applied to the common line C0 by the scanning portion 20, while predetermined currents are drawn by the driving portion 30 through the driving lines S0 to S2. Since the parasitic capacitances have been drawn out in the sub-frame 11, three light emitting elements 1 that are connected to the common line C0 can be driven at a desired amount of intensity as shown in FIG. 3A. Similarly, in the sub-frame 13, as shown in FIG. 3B, three light emitting elements 1 that are connected to C1 are driven at a desired amount of intensity. Thus, the parasitic capacitances of the lines will be also charged after the sub-frame 21. Since the operation after the cycle CL7 is similar to the cycles CL4 to CL6, their description is omitted for the sake of brevity.

As discussed above, the orders in which the common lines C are scanned by the scanning portion in the frames are different between successive cycles. Accordingly, although activation timing of the driving lines is not changed, since the scanning order of the common lines is set different between cycles, it is possible to distribute the dark line to the rows. Therefore, it is possible to make the dark line inconspicuous. As a result, it is possible to provide a quality display unit that can display the image without light emission unevenness caused by the dark line even in the case where a still image is displayed at low light intensity. In particular, in the case where the same image is displayed in successive cycles as still image, if only a particular row becomes dark, the particular row will be very conspicuous. According to the aforementioned control method, even in the case of a still image where a dark line is likely to be conspicuous, since the dark line does not appear only in a particular row, the dark line can be inconspicuous.

Second Embodiment

The method according to the foregoing embodiment has been described to change the row that is first driven depending on cycles so that the dark line cyclically appears in different rows depending on cycles. In this method, the rows of the display portion 10 are driven in a first light emission order in a first cycle, while the rows of the display portion 10 are driven next to the first cycle in a second light emission order so that the row that is first driven in the second light emission order is different from the row that is first driven in the first light emission order. However, the present invention is not limited to this method. One(s) of the rows can be driven in one frame in one cycle, and other one(s) or the other rows can be driven in the one frame or a frame following the one frame in the one cycle. According to this method, the row that is first driven in each cycle can be also changed depending on cycles. As a result, it is also possible to suppress the dark line.

An exemplary method according to a second embodiment is now described with reference to a timing chart of FIG. 4. In the second embodiment, although the scanning order of the common lines is fixed, the activation timing of the driving lines is controlled. In this embodiment, although the scanning portion controls the common lines C0 to C2 similarly to the method shown in FIG. 11 or the like, the driving portion can shift an activation timing period (a series of activation timing sub-frames) of the driving lines corresponding to one frame so that the activation timing sub-frames in this one frame overlaps the next frame. In the light emission control method shown in FIG. 4, each of the cycles CL7 to CL9 is divided into a plurality of frames FM1 to FM3. In addition, each of the frames is divided into three sub-frames as the minimum timing period for ON/OFF operation by the scanning portion and the driving portion.

The operation of the cycle CL7 is similar to the cycle CL4 in FIG. 2. That is, the scanning order of the common lines C is set to the order of the common lines C0, C1, and C2 in each frame. As a result, in the sub-frame 11 in the frame FM1, the voltage is applied to the common line C0 by the scanning portion 20, while predetermined currents are drawn by the driving portion 30 through the driving lines S0 to S2, as shown in FIG. 3H. The parasitic capacitance charged in the previous cycle CL6 (not shown) reduces the light intensity of the light emitting elements 1 that are connected to the common line C0 to a light intensity amount lower than a desired light intensity amount. That is, the dark line will appear in the common line C0 in the cycle CL7. In the next sub-frame 12, the voltage is applied to the common line C1 by the scanning portion 20, and predetermined currents are drawn by the driving portion 30 through the driving lines S0 to S2. As a result, three light emitting elements 1 that are connected to the common line C1 are driven at a desired light intensity amount as shown in FIG. 3B. Similarly, in the sub-frame 13, as shown in FIG. 3C, three light emitting elements 1 that are connected to the common line C2 are driven at a desired amount of intensity. Subsequently, in the sub-frame 21 in the frame FM2, as shown in FIG. 3D, although the voltage is applied to the common line C0, the driving portion 30 does not draw currents. Accordingly, the parasitic capacitances of the lines (S0, S1, and S2) will be charged. Also, in the sub-frame 22, as shown in FIG. 3E, although the voltage is applied to the common line C1, the driving portion 30 does not draw currents. Accordingly, the parasitic capacitances of the lines will be charged. Similarly, in the sub-frame 23, as shown in FIG. 3F, although the voltage is applied to the common line C2, the parasitic capacitances of the lines will be charged. Thus, the parasitic capacitances of the lines will be fully charged, and cannot be charged anymore as shown in FIG. 3G.

The operation in the cycle CL8 is now described. In the cycle CL8, the scanning order of the common lines C in each frame is fixed, in other words, the scanning order in the cycle CL8 is same as the cycle CL7. Although an activation timing period (a series of the activation timing sub-frames) of the driving lines corresponding to one frame extends only in the one frame in the cycle CL7, an activation timing period (a series of the activation timing sub-frames) of the driving lines corresponding to one frame extends over two successive frames in the cycle CL8.

In the sub-frame 11, as shown in FIG. 3D, although the voltage is applied to the common line C0, the driving portion 30 does not draw currents. Accordingly, the parasitic capacitances of the lines (S0, S1, and S2) will be charged.

Subsequently, in the sub-frame 12, as shown in FIG. 3I, the voltage is applied to the common line C1 by the scanning portion 20, and predetermined currents are drawn by the driving portion 30 through the driving lines S0 to S2, three light emitting elements 1 that are connected to the common line C1 are driven. The parasitic capacitance charged in the cycle CL7 and the sub-frame 11 of CL8 reduces the light intensity of the light emitting elements 1 that are connected to the common line C1, which is first driven in the cycle CL8, to a light intensity amount lower than a desired light intensity amount. That is, the dark line will appear in the common line C1 in the cycle CL8.

Subsequently, in the sub-frame 13, the voltage is applied to the common line C2 by the scanning portion 20, while predetermined currents are drawn by the driving portion 30 through the driving lines S0 to S2. Since the parasitic capacitances have been drawn out in the sub-frame 12, three light emitting elements 1 that are connected to the common line C2 can be driven at a desired amount of intensity as shown in FIG. 3C.

Similarly, in the sub-frame 21 in the frame FM2, as shown in FIG. 3A, three light emitting elements 1 that are connected to C0 are driven at a desired amount of intensity. After that, the parasitic capacitances of the lines will be also charged in the sub-frame 22 or later.

The operation of the cycle CL9 is now described. In the cycle CL9, the scanning order of the common lines C in each frame is fixed, in other words, the scanning order in the cycle CL9 is same as the cycles CL7 and CL8. Similar to the cycle CL8, an activation timing period (a series of the activation timing sub-frames) of the driving lines corresponding to one frame extends over two successive frames in the cycle CL9. In the cycle CL8, two of the three sub-frames are allocated to the frame FM1, and one of the three sub-frames is allocated to the frame FM2. In cycle CL9, one of the three sub-frames is allocated to the frame FM1, and two of the three sub-frames are allocated to the frame FM2.

In the sub-frame 11 in the frame FM1, as shown in FIG. 3D, although the voltage is applied to the common line C0, the driving portion 30 does not draw currents. Accordingly, the parasitic capacitances of the lines (S0, S1, and S2) will be charged. Subsequently, also in the sub-frame 12, as shown in FIG. 3E, although the voltage is applied to the common line C1, the driving portion 30 does not draw currents. Accordingly, the parasitic capacitances of the lines (S0, S1, and S2) will be charged.

Subsequently, in the sub-frame 13, as shown in FIG. 3J, the voltage is applied to the common line C2 by the scanning portion 20, and predetermined currents are drawn by the driving portion 30 through the driving lines S0 to S2, three light emitting elements 1 that are connected to the common line C2 are driven. In this case, since the parasitic capacitance is charged in the previous sub-frames, the parasitic capacitance reduces the light intensity of the light emitting elements 1 that are connected to the common line C2, which is first driven in the cycle CL9, to a light intensity amount lower than a light intensity amount driven by an originally-specified current. That is, the dark line will appear in the common line C2 in the cycle CL9.

Subsequently, in the sub-frame 21 in the frame FM2, as shown in FIG. 3A, three light emitting elements 1 that are connected to C0 are driven at a desired amount of intensity. Subsequently, in the sub-frame 22, as shown in FIG. 3B, three light emitting elements 1 that are connected to C1 are driven at a desired amount of intensity. After that, in the sub-frame 23, as shown in FIG. 3F, the driving lines are deactivated so that the parasitic capacitances of the lines will be charged. Subsequently, also in the frame FM3, the driving lines are deactivated so that the parasitic capacitances of the lines will be charged.

Figure 4:
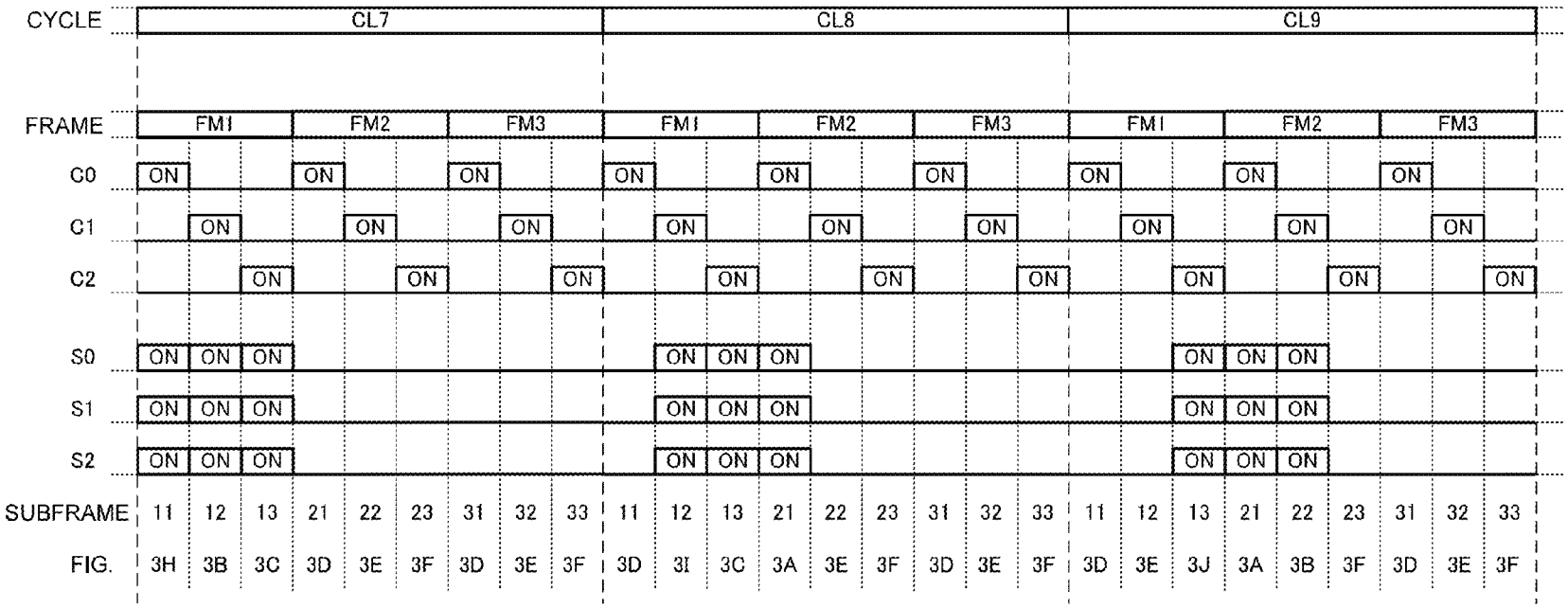
FIG. 4 is a timing chart showing a light emission control method according to a second embodiment of the present invention.

As discussed above, in the light emission control method shown in FIG. 4, the three activation timing sub-frames of the driving lines are allocated to the frame FM1 in the cycle CL7, to the frame FM1 (sub-frames 12 and 13) and the frame FM2 (only sub-frame 21) in the cycle CL8, and to the frame FM1 (only sub-frame 13) and the frame FM2 (sub-frames 21 and 22) in the cycle CL9. Thus, an activation timing period of the three activation timing sub-frames can extend over frames adjacent to each other. Accordingly, the dark line can cyclically appear depending on cycles in the order of the common lines C0, C1, and C2. As a result, the average values of the current amounts can be even so that the amounts of light intensity can be uniform. Therefore, it is possible to provide effects similar to the first embodiment.

In the case of FIG. 4, the duration of a non-light emission period (a series of non-light emission sub-frames) is seven sub-frames and constant. The number of seven sub-frames is greater by one sub-frame than the two frames (six sub-frames). Thus, the non-light emission period consists of a number of periods that is not an integral multiple of the number of sub-framed of one frame, and is shifted. Accordingly, the number of the non-light emission period can be fixed, while the activation timing period can extend over frames. Needless to say, in the case where the number of the non-light emission period is not fixed but variable, the activation timing period can be set to extend over frames.

Third Embodiment

Figure 5:
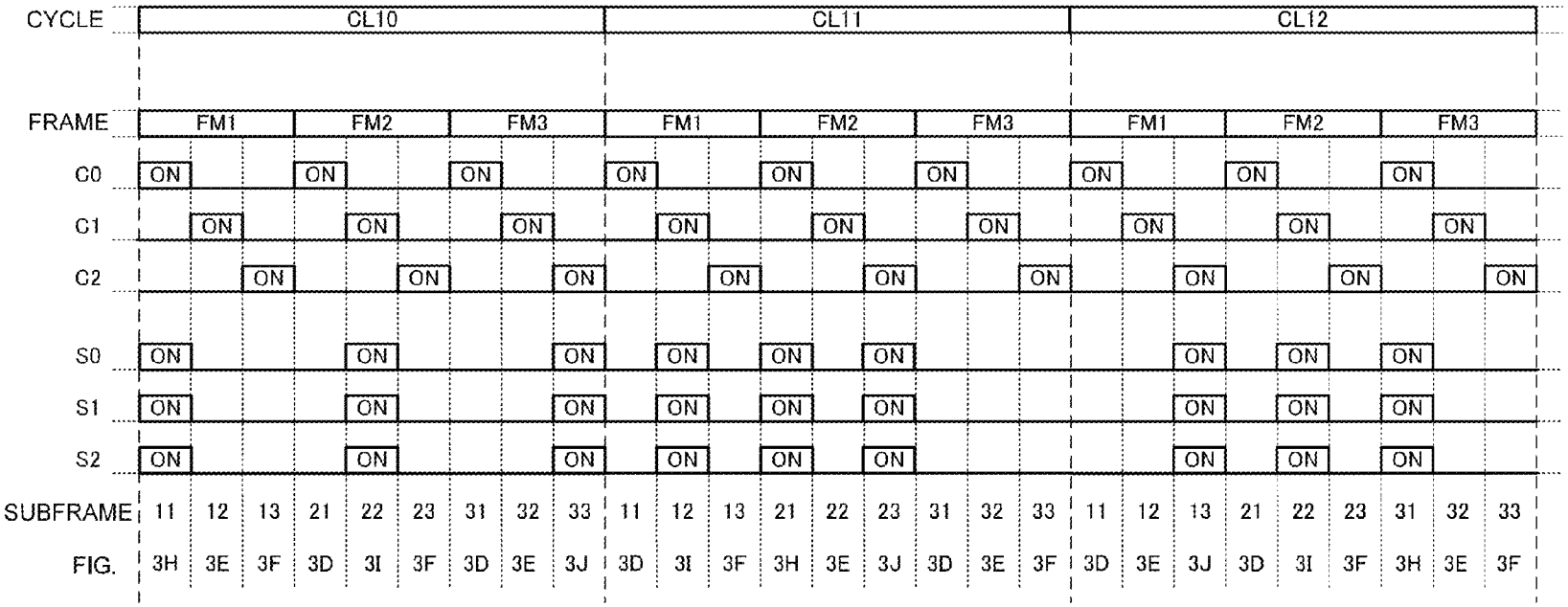
FIG. 5 is a timing chart showing a light emission control method according to a third embodiment of the present invention.

The foregoing second embodiment mentioned has been described to control the driving portion so that the activation timing period (a series of activation timing sub-frames) for activating the driving lines extends over frames, and the sub-frames for activating the driving lines continuously extend correspondingly to one frame. However, it is not necessary to control the driving line so that the sub-frames for activating the driving lines continuously extend correspondingly to one frame. The sub-frames for activating the driving lines can be distributed. FIG. 5 shows this type of control method according to a third embodiment. In this illustrated light emission control method, between the sub-frames where one row and the next rows are driven, the common lines are scanned, while the driving lines are deactivated (a non-light emission period are provided). That is, dissimilar to the foregoing first and second embodiments, a series of contiguous activation timing sub-frames for activating the driving lines is not provided, but discontiguous driving line activation timing periods each of which has a length of one sub-frame are distributed so that non-light emission periods where the light emitting elements are not driven are provided between the discontiguous driving line activation timing sub-frames. According to this construction, the activation sub-frames for activating the driving lines are distributed without changing the scanning control where the scanning portion activates the common lines so that the dark line can be suppressed. In particular, according to this method, it is possible to reduce the duration of a series of non-light emission sub-frames where the driving lines are deactivated, in other words, where the light emitting elements are not driven. Accordingly, it is possible to reduce the period of time where the parasitic capacitances are charged. Correspondingly, it is possible to suppress the reduction of light intensity.

The light emission control method according to the third embodiment is now described with reference to FIG. 5. Also in this embodiment, the common lines C0 to C2 are controlled in the order of the common lines C0, C1, and C2 by the scanning portion similar to the case of FIG. 11 or the like, while the driving line activation timing is controlled so that the dark line is suppressed. In the light emission control method shown in FIG. 5, each of the cycles CL10 to CL12 is divided into a plurality of frames FM1 to FM3. In addition, each of the frames is divided into three sub-frames as the minimum timing period for ON/OFF operation by the scanning portion and the driving portion.

In the cycle CL10, the driving lines are activated in the sub-frame 11 in the frame FM1, in the sub-frame 22 in the frame FM2, and in the sub-frame 33 in the frame FM3. That is, the driving line activation timing periods are distributed to the three frames so that each of the frames includes one driving line activation timing sub-frame. Specifically, in the sub-frame 11 in the frame FM1, the voltage is applied to the common line C0 by the scanning portion 20, while predetermined currents are drawn by the driving portion 30 through the driving lines S0 to S2, as shown in FIG. 3H. The parasitic capacitance charged in the previous cycle CL9 (not shown) reduces the intensity of the light emitting elements 1 that are connected to the common line C0 to a light intensity amount lower than a desired light intensity amount. That is, a first dark line will first appear in the common line C0 in the sub-frame 11 in the cycle CL10. Subsequently, in the sub-frame 12, as shown in FIG. 3E, although the voltage is applied to the common line C1 by the scanning portion 20, the driving portion 30 does not draw currents. Accordingly, the parasitic capacitances of the lines (S0, S1, and S2) will be charged. Also, in the sub-frame 13, as shown in FIG. 3F, although the voltage is applied to the common line C2, the driving portion 30 does not draw currents. Accordingly, the parasitic capacitances of the lines will be charged.

Subsequently, in the sub-frame 21 in the frame FM2, as shown in FIG. 3D, although the voltage is also applied to the common line C0, the parasitic capacitances of the lines will be charged. After that, in the sub-frame 22, as shown in FIG. 3I, the voltage is applied to the common line C1 by the scanning portion 20, and predetermined currents are drawn by the driving portion 30 through the driving lines S0 to S2, three light emitting elements 1 that are connected to the common line C1 are driven. The parasitic capacitance charged in the sub-frames 12, 13, and 21 reduces the light intensity of the light emitting elements 1 that are connected to the common line C1 to a light intensity amount lower than a desired light intensity amount. That is, a second dark line will appear in the common line C1 in the cycle CL10. Also, in the sub-frame 23, as shown in FIG. 3F, although the voltage is applied to the common line C2, the driving portion 30 does not draw currents. Accordingly, the parasitic capacitances of the lines will be charged.

Similarly, in the sub-frame 31 in the frame FM3, as shown in FIG. 3D, although the voltage is applied to the common line C0, the driving portion 30 does not draw currents. Accordingly, the parasitic capacitances of the lines (S0, S1, and S2) will be charged. Also, in the sub-frame 32, as shown in FIG. 3E, although the voltage is applied to the common line C1, the driving portion 30 does not draw currents. Accordingly, the parasitic capacitances of the lines will be charged. Subsequently, in the sub-frame 33, as shown in FIG. 3J, the voltage is applied to the common line C2 by the scanning portion 20, and predetermined currents are drawn by the driving portion 30 through the driving lines S0 to S2, three light emitting elements 1 that are connected to the common line C2 are driven. In this case, since the parasitic capacitance is charged in the previous sub-frames, the parasitic capacitance reduces the light intensity of the light emitting elements 1 that are connected to the common line C2 to a light intensity amount lower than a light intensity amount driven by an originally-specified current. That is, a third dark line will appear in the common line C2 in the cycle CL10.

Thus, in the cycle CL10, the dark line will appear in each frame. In addition, all driven rows will be dark lines. However, the non-light emission period (a series of the non-light emission sub-frames) in the embodiment has a length of three sub-frames, which is shorter as compared with the first and second embodiments. Correspondingly, the parasitic capacitances will be charged for a shorter time period so that the amount of charged capacity of the parasitic capacitance will be smaller. Accordingly, it is possible to reduce the amount of reduction current corresponding to the amount of charged capacity of the parasitic capacitance. In other words, it can be said that the light intensity reduction of the dark line in the cycle CL10 is smaller as compared with the first and second embodiments.

The operation in the cycle CL11 is now described. In the sub-frame 11 in the frame FM11, as shown in FIG. 3D, although the voltage is applied to the common line C0, the driving portion 30 does not draw currents. Accordingly, the parasitic capacitances of the lines (S0, S1, and S2) will be charged. Subsequently, in the sub-frame 12, as shown in FIG. 3I, the voltage is applied to the common line C1 by the scanning portion 20, and predetermined currents are drawn by the driving portion 30 through the driving lines S0 to S2, three light emitting elements 1 that are connected to the common line C1 are driven. The parasitic capacitance reduces the light intensity of the light emitting elements 1 that are connected to the common line C1 to a light intensity amount lower than a desired light intensity amount. Subsequently, in the sub-frame 13, as shown in FIG. 3F, although the voltage is applied to the common line C2, the parasitic capacitances of the lines will be charged.

After that, in the sub-frame 21 in the frame FM2, the voltage is applied to the common line C0 by the scanning portion 20, while predetermined currents are drawn by the driving portion 30 through the driving lines S0 to S2, as shown in FIG. 3H. The parasitic capacitance reduces the light intensity of the light emitting elements 1 that are connected to the common line C0 to a light intensity amount lower than a desired light intensity amount. Subsequently, in the sub-frame 22, as shown in FIG. 3E, although the voltage is applied to the common line C1 by the scanning portion 20, the driving portion 30 does not draw currents. Accordingly, the parasitic capacitances of the lines (S0, S1, and S2) will be charged. Subsequently, in the sub-frame 23, as shown in FIG. 3J, the voltage is applied to the common line C2 by the scanning portion 20, and predetermined currents are drawn by the driving portion 30 through the driving lines S0 to S2, three light emitting elements 1 that are connected to the common line C2 are driven. In this case, the light intensity of the light emitting elements 1 that are connected to the common line C2 is reduced by a light intensity amount corresponding to the parasitic capacitance.

In the frame FM3, the driving lines are deactivated so that the parasitic capacitances of the lines will be charged in the sub-frame 31 as shown in FIG. 3D, in the sub-frame 32 as shown in FIG. 3E, and in the sub-frame 33 as shown in FIG. 3F. Thus, the dark lines will appear in all of three light emission sub-frames in the cycle CL11. Specifically, the dark lines will appear in one sub-frame in the frame FM1 and two sub-frames in the frame FM2. In this cycle, since the non-light emission period has a length of one sub-frame, which is the minimum period, the reduction of current amount is minimized. For this reason, the reduction of light intensity can be very small as compared with the first and second embodiments.

The operation in the cycle CL12 is now described. In the cycle CL12, the scanning order of the common lines C in each frame is fixed, in other words, the scanning order in the cycle CL12 is same as the cycles CL10 and CL11. In the sub-frame 11 in the frame FM1, as shown in FIG. 3D, although the voltage is applied to the common line C0, the driving portion 30 does not draw currents. Accordingly, the parasitic capacitances of the lines (S0, S1, and S2) will be charged. Also, in the sub-frame 12, as shown in FIG. 3E, although the voltage is applied to the common line C1, the driving portion 30 does not draw currents. Accordingly, the parasitic capacitances of the lines will be charged. Subsequently, in the sub-frame 13, as shown in FIG. 3J, the voltage is applied to the common line C2 by the scanning portion 20, and predetermined currents are drawn by the driving portion 30 through the driving lines S0 to S2, three light emitting elements 1 that are connected to the common line C2 are driven. In this case, the light intensity of the light emitting elements 1 that are connected to the common line C2 is reduced by a light intensity amount corresponding to the parasitic capacitance.

In addition, in the sub-frame 21 in the frame FM2, as shown in FIG. 3D, although the voltage is applied to the common line C0, the driving portion 30 does not draw currents. Accordingly, the parasitic capacitances of the lines (S0, S1, and S2) will be charged. Subsequently, in the sub-frame 22, as shown in FIG. 3I, the voltage is applied to the common line C1 by the scanning portion 20, and predetermined currents are drawn by the driving portion 30 through the driving lines S0 to S2, three light emitting elements 1 that are connected to the common line C1 are driven. In this case, the light intensity of the light emitting elements 1 that are connected to the common line C1 is reduced by a light intensity amount corresponding to the parasitic capacitance. Also, in the sub-frame 23, as shown in FIG. 3F, although the voltage is applied to the common line C2, the parasitic capacitances of the lines will be charged.

In the sub-frame 31 in the frame FM3, the voltage is applied to the common line C0 by the scanning portion 20, while predetermined currents are drawn by the driving portion 30 through the driving lines S0 to S2, as shown in FIG. 3H. In this case, the light intensity of the light emitting elements 1 that are connected to the common line C0 is reduced by the parasitic capacitances to a light intensity amount lower than a desired light intensity amount. Also, in the sub-frame 32, as shown in FIG. 3E, although the voltage is applied to the common line C1, the driving portion 30 does not draw currents. Accordingly, the parasitic capacitances of the lines will be charged. Similarly, in the sub-frame 33, as shown in FIG. 3F, although the voltage is applied to the common line C2, the parasitic capacitances of the lines will be charged.

As discussed above, according to the third embodiment, since the duration of activation time period is minimized, a number of activation timing periods can be provided. Correspondingly, it is possible to reduce the duration of the non-light emission period (a series of non-light emission sub-frames), that is, the duration of the charge time period where the parasitic capacitance will be charged. As a result, the charged amount of parasitic capacitance can be reduced. Therefore, it is possible to suppress the amount of current that flows in the light emitting element. In this method, since the duration of the non-light emission period (a series of non-light emission sub-frames) is changed depending on cycles, the amounts of light intensity of the dark lines are not constant. In the case of FIG. 5, although the light emission timing pattern is changed depending on cycles of CL10 to CL12, the present invention is not limited to this. For example, the light emission timing pattern in the cycle CL10 may be repeated.

Fourth Embodiment

Figure 6:
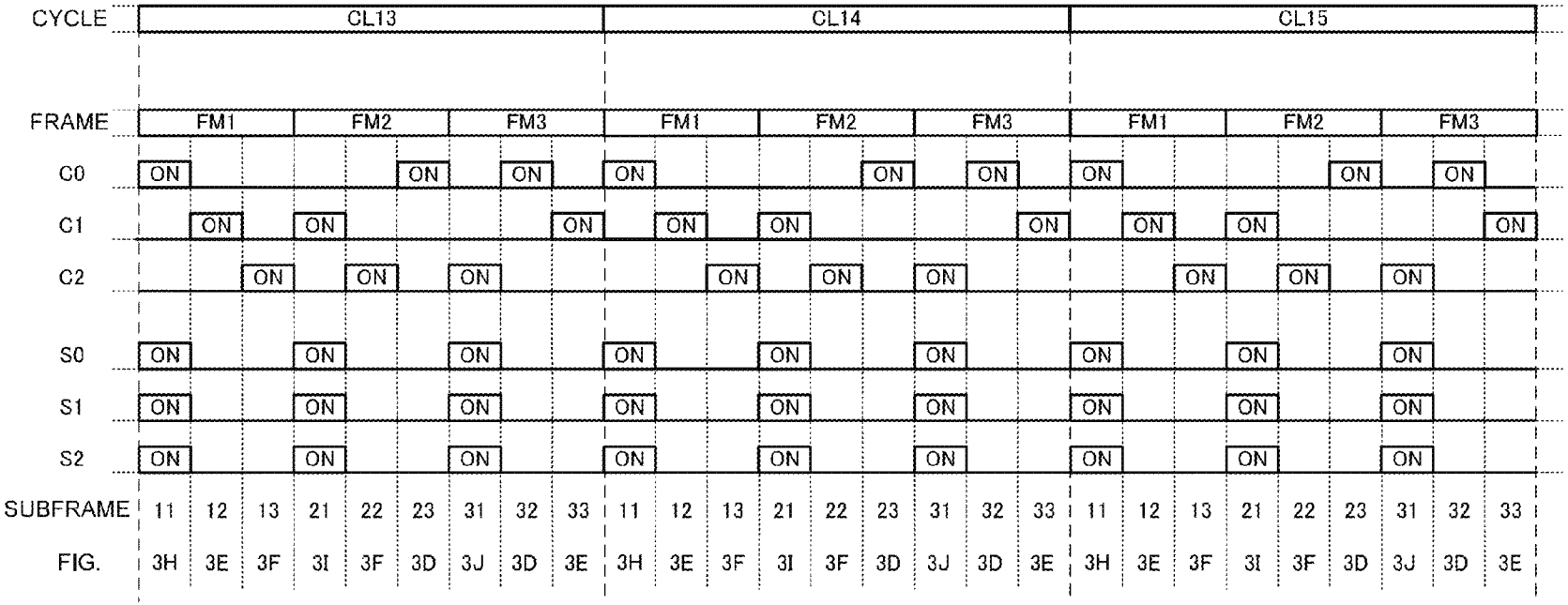
FIG. 6 is a timing chart showing a light emission control method according to a fourth embodiment of the present invention.

It has been described the foregoing embodiments that one of the scanning order of the common lines and the activation timing of the driving lines is changed so that the dark line will appear in different rows depending on frames. As a result, it can make the dark line inconspicuous in a particular row on the display portion in light emission. However, the present invention is not limited to this. Both the scanning order of the common lines and the activation timing of the driving lines can be changed. FIG. 6 shows this type of control method according to a fourth embodiment. In this illustrated light emission control method, since the duration of the non-light emission period (a series of the non-light emission sub-frames) is constant in each cycle, the light intensity of the dark line can be constant. That is, since the light intensity of dark lines can be constant, it is possible to prevent that a dark line with a darker light intensity appears. Specifically, the light emission control method is now described with reference to FIG. 6. In this embodiment, the light emitting elements are driven in the first sub-frame in each frame in each cycle. Accordingly, the duration of the non-light emission period (a series of non-light emission sub-frames) is two sub-frames. The driving portion controls the driving timing so that the driving line is activated only in the first sub-frame, and the other sub-frames are non-light emission sub-frames. On the other hand, the scanning order of the common lines is changed depending on frames in one cycle by the control of the scanning portion so that the common line that is first driven in the first sub-frame in each frame is changed depending on frames in the one cycle. According to this construction, it is possible to drive the light emitting elements only in the first sub-frame in each frame, and to change the common line scanning order depending on frames in one cycle.

In the control of the cycle CL13, in the sub-frame 11 in frame FM1, the voltage is applied to the common line C0 by the scanning portion 20, while predetermined currents are drawn by the driving portion 30 through the driving lines S0 to S2, as shown in FIG. 3H. The light intensity of the light emitting elements 1 that are connected to the common line C0 is reduced correspondingly to the parasitic capacitance charged in the previous cycle CL12 (not shown). Subsequently, in the sub-frame 12, as shown in FIG. 3E, although the voltage is applied to the common line C1 by the scanning portion 20, the driving portion 30 does not draw currents. Accordingly, the parasitic capacitances of the lines (S0, S1, and S2) will be charged. Also, in the sub-frame 13, as shown in FIG. 3F, although the voltage is applied to the common line C2, the driving portion 30 does not draw currents. Accordingly, the parasitic capacitances of the lines will be charged.

Subsequently, in the sub-frame 21 in the frame FM2, as shown in FIG. 3I, the voltage is applied to the common line C1 by the scanning portion 20, and predetermined currents are drawn by the driving portion 30 through the driving lines S0 to S2, three light emitting elements 1 that are connected to the common line C1 are driven. In this case, the light intensity of the light emitting elements 1 that are connected to the common line C1 is reduced correspondingly to the parasitic capacitances. Subsequently, in the sub-frame 22, as shown in FIG. 3F, although the voltage is applied to the common line C2, the driving portion 30 does not draw currents. Accordingly, the parasitic capacitances of the lines will be charged. Also, in the sub-frame 23, as shown in FIG. 3D, although the voltage is applied to the common line C0, the parasitic capacitances of the lines will be charged.

In the sub-frame 31 in the frame FM3, as shown in FIG. 3J, the voltage is applied to the common line C2 by the scanning portion 20, and predetermined currents are drawn by the driving portion 30 through the driving lines S0 to S2, three light emitting elements 1 that are connected to the common line C2 are driven. In this case, the light intensity of the light emitting elements 1 that are connected to the common line C2 is reduced correspondingly to the parasitic capacitances. Subsequently, in the sub-frame 32, as shown in FIG. 3D, although the voltage is applied to the common line C0, the driving portion 30 does not draw currents. Accordingly, the parasitic capacitances of the lines will be charged. Also, in the sub-frame 33, as shown in FIG. 3E, although the voltage is applied to the common line C1, the parasitic capacitances of the lines will be charged. The same procedure is repeated also in the subsequent cycles CL14 and CL15. As a result, the duration of the non-light emission period (a series of the non-light emission sub-frames) can be constant in the cycles.

As discussed above, since the light emitting elements are driven in the first sub-frame in each frame, and the duration of the non-light emission period can be constant, the light intensity of dark lines can be constant. That is, since the duration of the non-light emission period is two sub-frames and constant, the periods where electric charge is charged as the parasitic capacitances of the driving lines S0 to S2 can be constant. Accordingly, the light emission amounts of the light emitting elements in the rows can be constant. Therefore, it is possible to eliminate the dark line. In addition, since the scanning order pattern of the common lines and the activation timing pattern of the driving lines are fixed for cycles, the scanning portion and the driving portion can simply control the common lines and the driving lines.

The foregoing embodiments have been described that one cycle includes three frames, and one frame includes three sub-frames. However, needless to say, one cycle can include any number of frames, while one frame can includes any number of sub-frames.

(Display Portion 10)

The following description describes main components of the light emission display apparatus 100 that can emit light based on any of the light emission control methods according to the foregoing first to fourth embodiments. The display portion 10 includes the plurality of common lines C, which are arranged in the rows in parallel to each other, and the plurality of driving lines S, which are arranged in the columns perpendicular to the row in parallel to each other. The plurality of light emitting elements 1 are connected between the common lines C and the driving lines S. Thus, the light emitting elements 1 are arranged in a matrix. Specifically, the common lines C corresponds to the rows, while the driving lines S corresponds to the columns in FIG. 1. Thus, the light emitting elements 1 are arranged in a matrix with m rows and n columns. The cathode terminals of the light emitting elements 1 of each column is connected to corresponding one of the driving lines S, while the anode terminals of the light emitting elements 1 of each row is connected to corresponding one of the common lines C.

Although the display portion 10 is described to include the light emitting elements 1 that are arranged in a matrix with three rows and three columns, needless to say, the display portion can include light emitting elements that are arranged in a matrix with any number of rows and any number of columns. In this specification, the "row" and "column" refer to the horizontal and vertical directions, respectively, for ease of explanation. However, the "row" and "column" are not limited to the horizontal and vertical directions. That is, the "row" and "column" can have a directional relationship relative to each other. For example, the "row" and "column" may refer to the vertical and horizontal directions, respectively, in other words, the display unit 100 may be turned by 90 degrees in the clockwise or counterclockwise direction in FIG. 1.

(Light Emitting Element 1)

The light emitting elements 1 are semiconductor light emitting elements. Typically, light emitting diodes (LEDs) can be used as the semiconductor light emitting elements. In this embodiment, LEDs are used as the light emitting elements 1.

(Scanning Portion 20)

The scanning portion 20 is connected to the common lines C. Any of the common lines C can be scanned by the scanning portion 20 so that a voltage (e.g., 5 V) is applied to the selected one of the common lines C one after another. The scanning portion 20 includes switches (not shown) corresponding to the common lines C, and controls ON/OFF of the common lines C based on the instructions from the scanning order control portion 50.

(Driving Portion 30)

The driving portion 30 includes the driving elements (not shown) that are connected to the driving lines S, and can drive the light emitting elements 1 based on the instructions from a PWM controller 90. An image can be displayed in each cycle by combination of frame level control based on display data read from a RAM 70 and PWM level control controlled by a PWM controller 90 in each frame.

(Frame Division Portion 40)

The frame dividing portion 40 divides one cycle CL into a plurality of frames FM. One cycle CL corresponds to an image to be displayed that is generated by a timing controller 80 as discussed later.

In this embodiment, the display unit 100 includes the frame dividing portion 40. However, the display unit may be constructed without the frame dividing portion 40. The reason is that, even in the case where the display unit does not include the frame dividing portion, the parasitic capacitance on the driving line S will be charged if there is a time period where the driving portion 30 does not draw the current when the common line C is selected by the scanning portion 20. Also, in this case, the dark line may appear.

(Scanning Order Control Portion 50)

The scanning order control portion 50 can change the scanning order of the common lines C depending on cycles. The scanning order control portion 50 can autonomously control the scanning order of the common lines C. Alternatively, the scanning order control portion 50 may be constructed to control the scanning order of the common lines C based on the instructions from the outside. The common lines C are scanned by the scanning portion 20 based on the instructions from the scanning order control portion 50.

In FIG. 1, three common lines C are provided (C0, C1, and C2). In this embodiment, the common line C that is first scanned in each cycle is changed from C0 to C2 in successively ascending numeric order. In the case where the five or more common lines C are provided, the common line C that is first scanned in each cycle can be changed in discrete numeric order. That is, the scanning order control portion can control the scanning order so that the line numbers of the common lines that are first scanned in a predetermined cycle and the next cycle are discrete numbers. For example, in the case where the display unit includes the common lines C of C0 to C4, which are arranged in this order, the common line that is first selected in the first cycle is C0, the common line that is first selected in the subsequent cycle is set as C2, the common line that is first selected in the subsequent cycle is C4, the common line that is first selected in the subsequent cycle is C1, and the common line that is first selected in the subsequent cycle is C3, so that the common lines C are cyclically and repeatedly scanned in this order. In the case where the line numbers of the common lines that are first scanned in adjacent cycles are discrete numbers, it is possible to suppress the phenomenon where movement of the dark line moves in the scanning direction is perceived.

(Shift Register 60)

A shift register 60 provides display data DAT A_IN corresponding to an image from the outside in accordance with the shift clock CLK_IN. The shift register 60 can retain the display data, which includes frame level data and PWM level data for all of the light emitting elements 1 of the display portion 10.

(RAM 70)

A RAM 70 retains data in the shift register 60 in accordance with LATCH_IN. Although not illustrated, in order to control the display operation in the display portion 10, two or more independent RAMs are provided to read data from the frame dividing portion 40 and the PWM controller 90, and to write the display data from the outside, i.e., the data in the shift register 60.

(Timing Controller 80)

The timing controller 80 generates the cycle in accordance with VSYNC_IN, and controls the timing of the control portions.

(PWM Controller 90)

The PWM controller 90 controls the PWM level based on the display data read from the RAM 70 in the frame, which generated by the frame dividing portion 40.

Fifth Embodiment

Figure 7:
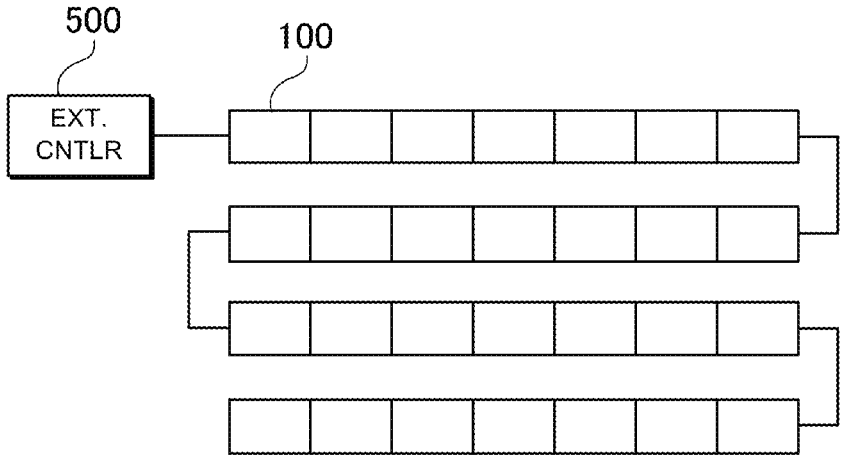
FIG. 7 is a block diagram for illustrating a display apparatus according to a fifth embodiment of the present invention.

Although the foregoing embodiments have been described to use the display unit alone, the present invention is not limited to this. A plurality of display units can be connected to each other so that a large display apparatus is constructed of the a plurality of display units. FIG. 7 shows this type of display system according to a fifth embodiment. In this illustrated display system, the plurality of display units 100 are connected to each other, while an external control portion 500 is connected to the end of a series of the plurality of display units 100. The external control portion 500 provides control data including display data and the like to the display units 100. Thus, the display system is constructed. Therefore, it is possible to provide a display system capable of suppressing the dark line.

Sixth Embodiment

Figure 8:
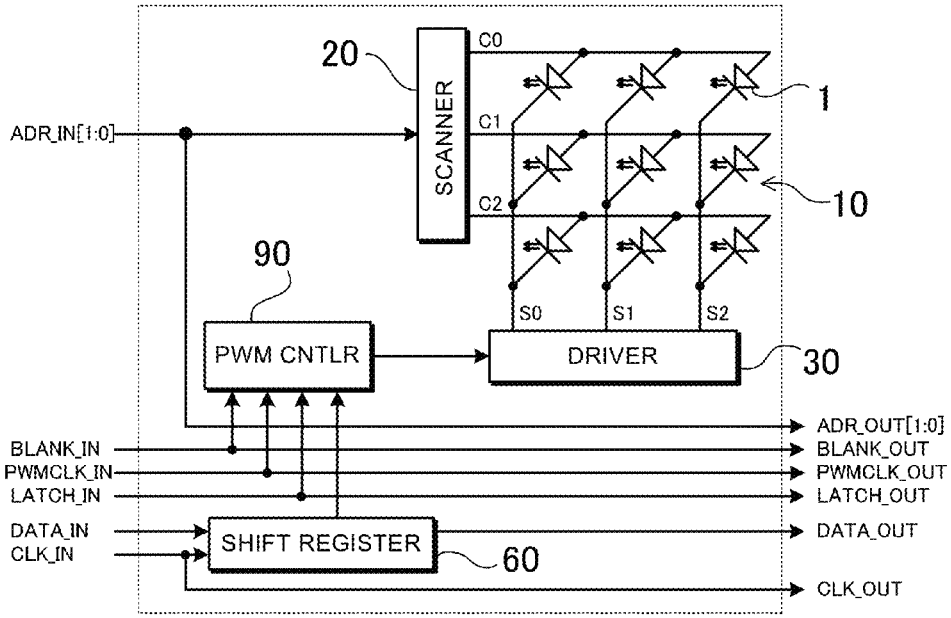
FIG. 8 is a block diagram for illustrating a display unit to be used for a display apparatus according to a sixth embodiment of the present invention.

In the display apparatus of the fifth embodiment, the scanning order in the cycle is controlled by the scanning order control portion 50, which is included in the display unit. However, even in the case where the display unit does not include the scanning order control portion 50, the scanning order can be changed depending on cycles by the control data from the external control portion. That is, the control data from the external control portion contains scanning order control data for setting the different scanning orders of the common lines, which are different between one cycle and the next cycle. According to this construction, it is possible to provide a display apparatus having effects similar to the fifth embodiment. FIG. 8 is a block diagram showing this type of display apparatus according to a sixth embodiment.

In the display apparatus according to this embodiment, the external control portion generates the frames, and controls the levels in each frame. The frames are combined so that an image is displayed in one cycle. The levels are controlled in each frame by controlling the PWM controller 90 based on PWMCLK_IN, which is a control signal from the external control portion, and BLANK_IN, which is a reset signal for a PWM counter.

The scanning portion 20 is controlled in each frame not by the scanning order control portion 50 but by scanning order control data ADR_IN [1:0] from the external control portion. In this embodiment, 2-bit data is enough to select one of C0 to C2. In the case where the scanning order is changed depending on cycles as shown in FIG. 2, it is possible to provide effects similar to the first embodiment.

Example 1

The following description describes a display unit according to an example 1 of the present invention that includes LEDs arranged in 32 rows×32 columns. Although not illustrated, the display portion includes four sets of common lines, and four sets of driving lines. Each set of common lines includes eight common lines C0 to C7. Each set of driving lines includes eight driving lines S0 to S7. 1024 LEDs are connected to the common and driving lines correspondingly at the intersection between the common and driving lines. More specifically, each of the LEDs includes three light emitting elements of red, green, and blue. The main components such as the scanning portion 20 and the driving portion 30 are similar to the first embodiment (FIG. 1), and their description is omitted for sake of brevity.

Figure 9:
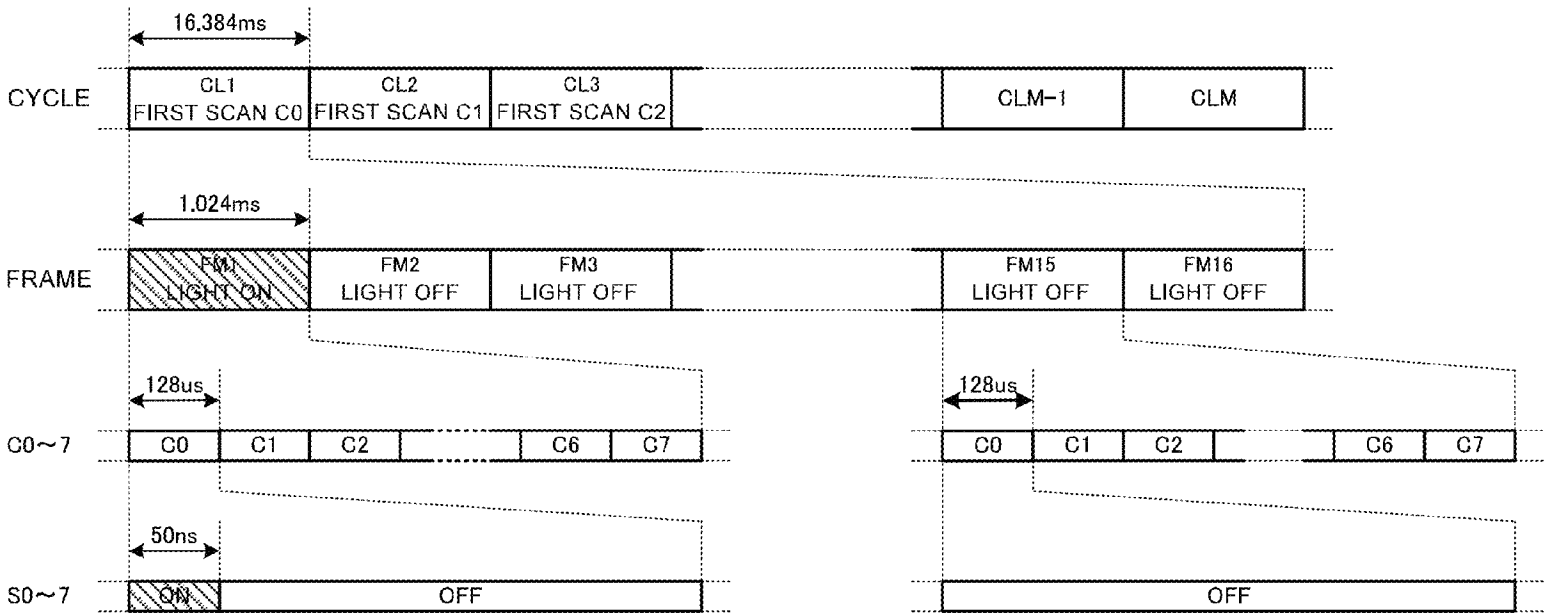
FIG. 9 is a timing chart showing the display unit according to the first embodiment of the present invention.

The display unit according to this example is driven in a ⅛-duty dynamic driving manner. As shown in a timing chart of FIG. 9, one cycle of 16.384 ms includes 16 frames, and the scanning order of the common lines C is changed depending on cycles. Specifically, in the cycle CL1, the common lines are scanned in the order of C0, C1, . . . , C6, and C7 in each frame. In CL2, the common lines are scanned in the order of C1, C2, . . . , C7, and C0 in each frame. In CL3, the common lines are scanned in the order of C2, C3, . . . , C0, and C1 in each FM. Thus, the scanning order is cyclically changed so that, after eight cycles, the scanning order returns to the first scanning order.

In this display unit, all of the LEDs are driven in FM1 in every cycle for 50 ns, which is the minimum time unit where the dark line is likely to be conspicuous. Even in the case where all of the LEDs are driven at the minimum light intensity, the dark line can be inconspicuous in this example as compared with a comparative example 1. According to this example, a quality display unit can be provided.

Comparative Example 1

The same display unit as the example 1 is produced as a comparative example 1 except that the scanning order is set to the order of C0, C1, . . . , C6, and C7 in each frame for every cycles. In the comparative example 1, when all of the LEDs are driven in FM1 in every cycle for 50 ns, which is the minimum time unit, the dark line appears in the LEDs that are arranged in C0.

INDUSTRIAL APPLICABILITY

A display apparatus light emission control method and display unit according to the present invention can be used for a large television and traffic information, for example.

It should be apparent to those with an ordinary skill in the art that while various preferred embodiments of the invention have been shown and described, it is contemplated that the invention is not limited to the particular embodiments disclosed, which are deemed to be merely illustrative of the inventive concepts and should not be interpreted as limiting the scope of the invention, and which are suitable for all modifications and changes falling within the scope of the invention as defined in the appended claims. The present application is based on Application No. 2011-250,182 filed in Japan on Nov. 15, 2011, the content of which is incorporated herein by reference.

What is claimed is:

1. A light emission control method for a display apparatus, the display apparatus including a display portion that includes a plurality of light emitting elements that are arranged in a matrix form comprising rows and columns, the rows comprising a first row and a second row, a scanning portion that is connected to a plurality of common lines each of which is connected to the anode terminals of corresponding elements of said plurality of light emitting elements that are arranged in corresponding one of the rows of said display portion so that said common lines are scanned, the scanning portion applying a voltage to selected one of said common lines, and a driving portion that is connected to a plurality of driving lines each of which is connected to the cathodes terminals of corresponding elements of said plurality of light emitting elements that are arranged in corresponding one of the columns of said display portion, the driving portion driving selected elements of said plurality of light emitting elements when one of said common lines corresponding to the selected elements is scanned by the scanning portion, wherein the display apparatus displays an image in each cycle that includes a plurality of frames, wherein all of said common lines are scanned by said scanning portion in each of said plurality of frames, the light emission control method comprises:

driving the first row in one frame in one cycle; and driving the second row or remaining rows other than the first row in a frame after the one frame in the one cycle.

2. The light emission control method according to claim 1, wherein a non-light-emission period is provided between a driving sub-frame in which a predetermined row(s) is/are driven and the next driving sub-frame in which other row(s) is/are driven, and wherein in the non-light-emission period, one or more common lines are scanned by said scanning portion and said driving portion prevents current flows in said light emitting elements.

3. The light emission control method according to claim 2, wherein said duration of a non-light-emission period is constant.

4. The light emission control method according to claim 1, wherein the same image is displayed in continuous cycles.

5. A light emission control method for a display apparatus, the display apparatus including a display portion that includes a plurality of light emitting elements that are arranged in a matrix form comprising rows and columns, a scanning portion that is connected to a plurality of common lines each of which is connected to the anode terminals of corresponding elements of said plurality of light emitting elements that are arranged in corresponding one of the rows of said display portion so that said common lines are scanned, the scanning portion applying a voltage to selected one of said common lines, and a driving portion that is connected to a plurality of driving lines each of which is connected to the cathodes terminals of corresponding elements of said plurality of light emitting elements that are arranged in corresponding one of the columns of said display portion, the driving portion driving selected elements of said plurality of light emitting elements when one of said common lines corresponding to the selected elements is scanned by the scanning portion, and wherein the display apparatus displays an image in each cycle that includes a plurality of frames, wherein all of said common lines are scanned by said scanning portion in each of said plurality of frames, the light emission control method comprises:

driving each row of said display portion in a first light emission order whereby displaying the image in a first cycle, and driving each row of said display portion in a second cycle next to said first cycle in a second light emission order whereby displaying the image same as said first cycle, wherein the second light emission order is different from the first light emission order in which a row to be driven first in the second light emission order is different from a row to be driven first in the first light emission order.

6. The light emission control method according to claim 5, wherein a non-light-emission period is provided between a driving sub-frame in which a predetermined row(s) is/are driven and the next driving sub-frame in which other row(s) is/are driven, wherein in the non-light-emission period, one or more common lines are scanned by said scanning portion and said driving portion prevents current flows in said light emitting elements.

7. The light emission control method according to claim 5, wherein the orders in which said common lines are scanned in the frames by said scanning portion are different between successive cycles.

8. A display unit comprising:

a display portion that includes a plurality of light emitting elements that are arranged in a matrix form comprising rows and columns, the rows comprising a first row and a second row;

a scanning portion that is connected to a plurality of common lines each of which is connected to the anode terminals of corresponding elements of said plurality of light emitting elements that are arranged in corresponding one of the rows of said display portion so that said common lines are scanned, the scanning portion applying a voltage to selected one of said common lines; and a driving portion that is connected to a plurality of driving lines each of which is connected to the cathodes terminals of corresponding elements of said plurality of light emitting elements that are arranged in corresponding one of the columns of said display portion, the driving portion driving selected elements of said plurality of light emitting elements when one of said common lines corresponding to the selected elements is scanned by the scanning portion, wherein the display unit is constructed to display an image in each cycle that includes a plurality of frames, wherein all of said common lines are scanned by said scanning portion in each of said plurality of frames, wherein the display unit further comprises a light emission control portion that drives the first row in one frame in one cycle, and drives the second row or remaining rows other than the first row in another frame in the one cycle.

9. The display unit according to claim 8, wherein said light emission control portion has a non-light-emission period that is provided between a driving sub-frame in which a predetermined row(s) is/are driven and the next driving sub-frame in which other row(s) is/are driven, wherein in the non-light-emission period, one or more common lines are scanned by said scanning portion and said driving portion prevents current flows in said light emitting elements.

10. The display unit according to claim 9, wherein said non-light emission period of said light emission control portion is constant.

11. The display unit according to claim 8, wherein the display unit displays the same image on said display portion in continuous cycles.

12. A display unit comprising:

a display portion that includes a plurality of light emitting elements that are arranged in a matrix form comprising rows and columns;

a scanning portion that is connected to a plurality of common lines each of which is connected to the anode terminals of corresponding elements of said plurality of light emitting elements that are arranged in corresponding one of the rows of said display portion so that said common lines are scanned, the scanning portion applying a voltage to selected one of said common lines; and a driving portion that is connected to a plurality of driving lines each of which is connected to the cathodes terminals of corresponding elements of said plurality of light emitting elements that are arranged in corresponding one of the columns of said display portion, the driving portion driving selected elements of said plurality of light emitting elements when one of said common lines corresponding to the selected elements is scanned by the scanning portion, wherein the display unit is constructed to display an image in each cycle that includes a plurality of frames, wherein all of said common lines are scanned by said scanning portion in each of said plurality of frames, wherein the display unit further comprises a light emission control portion that, when displaying the same image in successive first and second cycles, controls the driving orders so that a row to be driven first in a second light emission order is different from a row to be driven first in a first light emission order.

13. The display unit according to claim 12, wherein said light emission control portion has a non-light-emission period that is provided between a driving sub-frame in which a predetermined row(s) is/are driven and the next driving sub-frame in which other row(s) is/are driven, wherein in the non-light-emission period, one or more common lines are scanned by said scanning portion and said driving portion prevents current flows in said light emitting elements.

14. The display unit according to claim 12, wherein said light emission control portion controls the driving orders so that the orders in which said common lines are scanned in the frames by said scanning portion are different between successive cycles.

* * * * *